US008693905B2

(12) United States Patent
Willard

(10) Patent No.: US 8,693,905 B2
(45) Date of Patent: Apr. 8, 2014

(54) SYSTEMS AND METHODS FOR REDUCING RELOAD IMAGE QUALITY DEFECTS

(75) Inventor: W. Bradford Willard, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 319 days.

(21) Appl. No.: 13/025,258

(22) Filed: Feb. 11, 2011

(65) Prior Publication Data

US 2012/0207499 A1 Aug. 16, 2012

(51) Int. Cl.
*G03G 15/08* (2006.01)
*G03G 15/06* (2006.01)

(52) U.S. Cl.
USPC ..... 399/53; 399/55

(58) Field of Classification Search
USPC ..... 399/53, 55, 236, 281
See application file for complete search history.

(56) References Cited

U.S. PATENT DOCUMENTS 4,607,933 A * 8/1986 Haneda et al. ..... 430/122.4
5,031,570 A 7/1991 Hays et al.
5,666,619 A 9/1997 Hart et al.
5,890,042 A 3/1999 Wong et al.
2004/0170442 A1* 9/2004 Forbes et al. ..... 399/27

FOREIGN PATENT DOCUMENTS

JP 60130773 A * 7/1985
JP 06067527 A * 3/1994

OTHER PUBLICATIONS

Sugano et al. (JP 06-067527 A, Mar. 1994) JPO Machine Translation.*
U.S. Appl. No. 12/634,822, filed Dec. 10, 2009.

* cited by examiner

*Primary Examiner* — David Gray
*Assistant Examiner* — Erika J Villaluna
(74) *Attorney, Agent, or Firm* — Oliff PLC

(57) ABSTRACT

An image forming apparatus includes a sensor that detects a property of a developer material, a transport unit that contacts the developer material and moves the developer material toward a recording medium, and a controller that receives the data regarding the property of the developer material from the sensor unit and sets both a voltage and a velocity of the transport unit, wherein the voltage and the velocity is determined based on data regarding the detected property of the developer material received from the sensor.

13 Claims, 7 Drawing Sheets

| Y-hat Model | | Black Reload | | | |
|---|---|---|---|---|---|
| Factor | Name | Coeff | P(2 Tail) | Tol | ACTIVE |
| Const | | 0.34532 | 0.0000 | | |
| A | Mag Speed | -0.09261 | 0.0000 | 1.0000 | X |
| B | VdmAC | -0.08508 | 0.0000 | 0.9997 | X |
| C | Toner Age Slope | 0.02669 | 0.0037 | 0.9995 | X |
| D | Toner Age | -0.26578 | 0.0000 | 0.9992 | X |
| BB | | 0.10541 | 0.0000 | 0.8999 | X |
| | $R^2$ | 0.9190 | | | |
| | Adj $R^2$ | 0.9127 | | | |
| | Std Error | 0.0663 | | | |
| | F | 145.2791 | | | |
| | Sig F | 0.0000 | | | |
| | $F_{LOF}$ | NA | | | |
| | Sig $F_{LOF}$ | NA | | | |
| | Source | SS | df | MS | |
| | Regression | 3.2 | 5 | 0.6 | |
| | Error | 0.3 | 64 | 0.0 | |
| | ErrorPure | NA | 0 | NA | |
| | ErrorLOF | NA | 0 | NA | |
| | Total | 3.5 | 69 | | |
| Current DPM | | | | | 159.072 |
| Optimized dpm | | | | | 3.597 |

SYSTEMS AND METHODS FOR REDUCING RELOAD IMAGE QUALITY DEFECTS

BACKGROUND

This disclosure is generally directed to electrostatographic imaging devices. More specifically, this disclosure is directed to reducing or eliminating the image quality defect known as reload.

In the known process of electrostatographic printing, a charge retentive surface, typically known as a photoreceptor, is electrostatically charged and then exposed to a pattern of activating electromagnetic radiation, such as light. The radiation selectively dissipates the charge on the illuminated areas of the charge retentive surface while leaving behind an electrostatic image on the non-illuminated surfaces. The resulting pattern of charged and discharged areas on the photoreceptor form an electrostatic charge pattern, known as a latent image, conforming to the original image.

Next, the latent image is developed by contacting the latent image to an electrostatically attractable toner. Toner is held on the image areas by the electrostatic charge on the photoreceptor surface. Thus, a toner image is produced in conformity with a light image of the image being produced. The toner image may then be transferred to a substrate or recording medium, and the image is then fixed on the substrate to form a permanent record of the image, or output image. Subsequent to development, excess toner left on the charge retentive surface is cleaned from the surface. The process is useful for copying from an original, or printing electronically generated or stored originals.

In the operation of electrostatographic printing, there arises a defect known as reload. Reload refers to a situation where a roller within a development station fails to properly and completely be reloaded with an appropriate amount of toner after one cycle through the development process in preparation for the next cycle. Reload becomes more and more drastic when a machine engaging in electrostatographic image production is used to produce large quantities of images at high speeds.

U.S. Pat. No. 5,031,570 discloses an apparatus for developing latent electrostatic images on a charge retentive surface with toner. The disclosed apparatus includes a supply of two-component developer having toner and carrier beads, a developer transport structure spaced from the charge retentive surface for conveying developer from the supply of developer to an area opposite the charge retentive surface without contacting the surface, an electrode structure, and a device for establishing an alternating electrostatic field between the developer transport structure and the electrode structure for creating a cloud of toner proximate the electrode structure. The electrode structure can include a plurality of wires operatively connected to an AC power source and positioned in a space between the charge retentive surface and developer transport structure, and a device for creating an electrostatic field between the charge retentive surface and the electrode structure for effecting movement of toner from the cloud of toner to the latent electrostatic images. The transport structure can include a magnetic brush structure having the north and south poles of the brush structure arranged such that the magnetic field is established in the space. This magnetic field does not cause the developer to contact the charge retentive surface. The transport structure can also include a plurality of unbiased wires to agitate the developer on the magnetic brush structure.

U.S. Pat. No. 5,666,619 discloses an apparatus for developing a latent image recorded on a surface. The disclosed device includes a housing defining a chamber storing a supply of developer material, a donor roll spaced from the surface and adapted to transport the developer material to a development zone adjacent the surface, and an electrode wire positioned in the space between the surface and the donor roll. The electrode wire can be electrically biased to detach the developer material from the donor roll to form a cloud of developer material in the space between the electrode wire and the surface with the developer material developing the latent image. The device can also include a wire module providing a device for attaching the ends of the wire and tensioning the electrode wire, and a device for supporting the electrode wire along the length of the wire. The supporting device can be rotatably mounted with respect to the donor roll and located along the donor roll shaft between each end of the donor roll and the donor roll support and having a wire support surface which supports the wire in the vertical direction when the electrode wire is positioned in the space between the surface and the donor roll. The support device can have two support legs separated by an open section, the open section allowing the support device to fit over the donor roll shaft, the two legs of the support device are attached to the housing.

U.S. Pat. No. 5,890,042 discloses an apparatus for developing a latent electrostatic image on a charge retentive surface with toner. The apparatus can include a supply of toner, a donor structure spaced from the charge retentive surface for conveying toner from the supply of toner to an area adjacent the charge retentive surface. The donor structure can have a continuous surface, and a device for applying an alternating current directly to the donor structure to create an alternating electrostatic field between the donor structure and the charge retentive surface to produce a toner cloud adjacent the charge retentive surface for developing the latent electrostatic image thereon.

To reduce reload image quality defects, the voltage across a transport structure can be adjusted based on data regarding toner age, for example. See U.S. patent application Ser. No. 12/634,822. However, the applied voltage range is only effective over a limited range of toner ages. When toner age increases beyond an effective voltage range, the velocity of the transport structure may be manually adjusted to properly compensate and facilitate reducing reload image quality defects. Manual velocity adjustment of the transport structure can still lead to mottle or other image defects at low throughput in high toner age conditions. As the process speed for the image forming apparatus increases, the frequency of occurrence of low toner age conditions will increase. This condition will cause an increase in the need for automated intervention to promote image quality.

SUMMARY

This disclosure describes systems and methods to address the shortfalls in prior art systems discussed above by providing means of adjusting both voltage and velocity of the transport structure simultaneously and instantaneously to control reload using toner age.

Advantages that may be associated with the systems and methods according to this disclosure include improved reload control over all toner ages while minimizing image defects due to other causes at high toner age. Voltage and velocity adjustments can also be made to the transport structure based on other variables such as, for example, area coverage that a printer is printing and the temperature of the toner.

Reload defects can be reduced or eliminated in an image forming apparatus where both the AC potential across a transport roll and the velocity of the transport roll are varied depending on a measured or sensed property of the developer material, such as toner age.

Exemplary systems and methods according to this disclosure may provide an image forming apparatus including a sensor that detects a property of a developer material, a transport unit that contacts the developer material and that moves the developer material toward a recording medium, and a controller that receives data representative of the detected property of the developer material from the sensor. The controller may further set both a voltage and a velocity of the transport unit, the voltage and velocity being determined based on the data regarding the detected property of the developer material received from the sensor.

Further, the exemplary systems and methods according to this disclosure may provide a system for forming an image including a means for detecting a property of a developer material, a means for moving the developer material toward a recording medium, and a means for setting both a voltage and a velocity of the moving means based on data regarding the detected property of the developer material received from the detecting means.

Finally, the exemplary systems and methods according to this disclosure may provide a method for forming an image including detecting a property of a developer material, moving the developer material toward a recording medium, and setting both a voltage and a velocity of a transport unit to move the developer material based on data regarding the detected property of the developer material.

These and other features and advantages of the disclosed systems and methods are described in, or apparent from, the following detailed description of embodiments.

BRIEF DESCRIPTION OF THE DRAWINGS

Various exemplary embodiments of disclosed systems and methods for enhancing image quality in an image forming device will be described, in detail, with reference to the following drawings, wherein.

EMBODIMENTS

Figure 1:
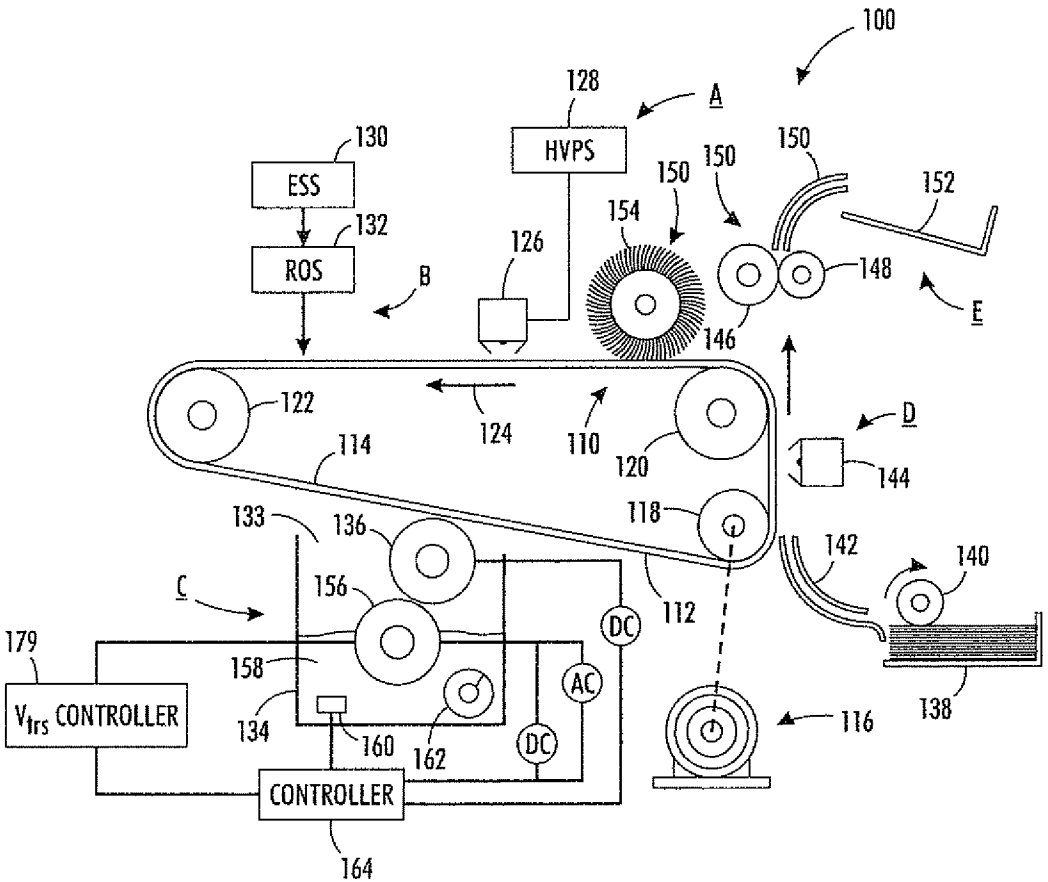
FIG. 1 illustrates an exemplary electrostatogaphic printing apparatus according to this disclosure.

FIG. 1 illustrates an electrostatographic printing apparatus 100 having an image forming apparatus according to this disclosure. The electrostatographic printing apparatus 100 can include a photoreceptor, shown as a belt 110, having a photoconductive surface 112 on an electroconductive substrate 114. A motor 116 can drive the belt 110 along a path defined by rollers 118, 120 and 122 in the direction shown by arrow 124. Initially, a portion of the belt 110 can pass through a charge station A where a corona generating device 126 may charge photoconductive surface 112 to a substantially uniform potential. A high voltage power supply 128 may be connected to corona generating device 126. After charging, the charged area can be passed to exposure station B.

At exposure station B, an electronic subsystem (ESS) 130 can receive image signals representing the desired output image and process the received image signals to convert the received image signals to a continuous tone rendition of the image. The continuous tone rendition of the image can be transmitted to a modulated output generator, for example, a raster output scanner (ROS) 132. Generally, the ESS 130 can be a self-contained, dedicated minicomputer. However, the ESS 130 may take other forms such as the image signals transmitted to the ESS 130 may originate from a raster input scanner (RIS) (not shown) or from a computer. In this manner, the electrostatographic printing apparatus 100 can serve as a machine for copying original documents, or as a printer for one or many computers, remotely or locally connected to the electrostatographic printing apparatus 100.

For use as a copier, an original document may be positioned in a document handler of an RIS. The RIS can capture the original document and convert the original document to a series of raster scan lines. The information can be transmitted to the ESS 130, which can control the ROS 132, as described above.

The signals from the ESS 130, which correspond to the continuous tone image produced by the electrostatographic printing apparatus 100, can be transmitted to the ROS 132. The ROS 132 can include a laser with rotating mirror blocks. The ROS 132 can expose the photoconductive surface 112 to record an electrostatic latent image corresponding to the continuous tone image received from the ESS 130. Alternatively, the ROS 132 may contain a linear array of light emitting diodes arranged to illuminate the charged portion of the photoconductive surface 112 on a raster-by-raster basis, or by any other technique, to record a latent image on the photoconductive surface 112.

After the electrostatic latent image has been recorded on the photoconductive surface 112, belt 110 can advance the latent image to development station C. At development station C, a development system 133 can be disposed in a housing 134 and develop the latent image recorded on the photoconductive surface 112. The development system 133 can include a donor roll 136 positioned near to the photoconductive surface 112. The donor roll 136 can be mounted, at least partially, in the housing 134 where a developer material 158 can be supplied.

The developer material 158 can be a one-component developer material of triboelectrically charged toner, or a two-component developer material of at least magnetic carrier granules triboelectrically connected to toner particles. An auger 162 can be situated at the bottom of the housing 134 and can distribute the developer material 158 evenly along the length of the housing 134.

A transport roll 156 can be disposed within the housing 134 and can convey the developer material 158 to the donor roll 136. The transport roll 156 can be electrically biased relative to the donor roll 136 so that the toner particles are attracted from the transport roll 156 to the donor roll 136. The toner can be further electromagnetically detached from the donor roll 136 so as to form a toner powder cloud in a space between the donor roll 136 and the photoconductive surface 112. The electrostatic charge of the latent image attracts toner particles from the toner powder cloud to form a toner powder image on the photoconductive surface 112 according to an adjustable voltage.

A direct current attraction voltage of the transport roll 156 can be adjusted relative to the voltage of the donor roll 136 to control an amount of toner attracted to the donor roll 136.

An alternating current attraction voltage of the transport roll 156 can also be adjusted relative to the voltage of the donor roll 136 to control an amount of toner attracted to the donor roll 136.

A velocity of the transport roll 156 can also be adjusted relative to the donor roll 136 so that the amount of toner applied to the donor roll 136 is controlled. The voltage and the velocity of the transport roll 156 can be adjusted simultaneously or independently to achieve a desired print quality.

A sensor 160 can detect, continuously or at intervals, a property of the developer material 158, and can be situated within the housing 134. The sensor 160 can transmit, continuously or at intervals (predetermined or random), data relating to the detected property of the developer material 158 to a controller 164 disposed within the electrostatographic printing apparatus 100. Based on the data relating to the detected property, the controller 164 can vary both the voltage and the velocity applied to the transport roll 156. By doing so, the controller 164 can account for variations in properties of the developer material 158 to maintain high printing quality.

After the electrostatic image has been developed, the belt 110 can advance the developed image to transfer station D, where a recording medium 138 can be advanced by roll 140 and guides 142 into contact with the developed image on belt 110. A corona generating device 144 can be used to spray ions onto the back of the recording medium 138 to attract the toner image from the belt 110 to the recording medium 138. As the belt 110 turns around roller 120, the recording medium 138 can be stripped from the belt 110 now having the toner image on a surface of the recording medium 138.

After transfer, the recording medium 138 can be advanced to fusing station E. Fusing station E can include a heated fusing roller 146 and a back-up roller 148. The recording medium 138 can pass between fusing roller 146 and back-up roller 148 with the toner powder image contacting fusing roller 146. Here, the toner image can be permanently affixed to the recording medium 138 by application of one or both of heat and pressure. After fusing, the recording medium 138 can advance through chute 150 to catch tray 152 for subsequent removal.

After the recording medium has been separated from the surface 112 of the belt 110, residual toner particles left adhering to the photoconductive surface 112 can be removed at cleaning station F by a rotatably mounted fibrous brush 154, or similar cleaning device, in contact with the photoconductive surface 112. After cleaning, a discharge lamp (not shown) can flood the photoconductive surface 112 with light to dissipate residual electrostatic charge remaining prior to charging the photoconductive surface 112 for a successive imaging cycle.

In operation, the controller 164 can set a direct current potential $Vdr_{DC}$ of the donor roll 136, a direct current potential $Vtr_{DC}$ of the transport roll 156 and an alternating current potential $Vtr_{AC}$ of the transport roll 156. By adjusting the Vtrs controller 179, the controller 164 can set the rotational speed Vtrs [velocity transport roll speed] of the transport roll 156. The potentials $Vdr_{DC}$ of the donor roll 136 and $Vtr_{DC}$ of the transport roll 156 can be set to predetermined potentials. At the same time, the controller 164 can adjust the alternating current potential $Vtr_{AC}$ of the transport roll 156 and by adjusting the Vtrs controller 179, set the rotational speed Vtrs of the transport roll 156. Both the potential $Vtr_{AC}$ and the rotational speed Vtrs of the transport roll 156 can be variably set, continuously or at intervals (generally predetermined), by the controller 164 based on the data regarding the property of the developer material detected by the sensor 160.

In embodiments that use a two-component developer material, the developer material 158 may include a quantity of magnetic carrier beads in addition to the toner particles intended to adhere to the photoconductive surface 112. The toner particles can adhere triboelectrically to the relatively large carrier beads. When the developer material 158 is placed in a magnetic field, the carrier beads with the adhered toner particles can form a magnetic brush. Here, the carrier beads may form relatively long chains that may be viewed as resembling, for example, the fibers of a brush upon the transport roll 156. The carrier beads can form chains extending from the surface of the transport roll 156, and the toner particles can be electrostatically attracted to those chains. When the magnetic brush is introduced into the development station C, the electrostatic charge on the photoconductive surface 112 can cause the toner particles to be pulled off the carrier beads and onto the photoconductive surface 112 in a case where no donor roll 136 is used or the electrostatic charge on the donor roll 136 can cause the toner particles to be pulled off the carrier beads and onto the donor roll 136 in a case where a donor roll 136 is used.

In embodiments that use a single-component developer material, the developer material 158 may consist entirely of toner. Each toner particle can have both an electrostatic charge (to enable the particles to adhere to the photoconductive surface 112 in a case where no donor roll 136 is used or to enable the particles to adhere to the donor roll 136 in a case where a donor roll 136 is used); and magnetic properties (to allow the particles to be magnetically conveyed to the photoconductive surface 112 in a case where no donor roll 136 is used or to allow the particles to be magnetically conveyed to the donor roll 136 in a case where a donor roll 136 is used). Instead of using magnetic carrier beads to form a magnetic brush, the magnetized toner particles can be caused to adhere directly to the transport roll 156. In the development station C, the electrostatic charge on the photoconductive surface 112 can cause the toner particles to be pulled from the transport roll 156 in a case where no donor roll 136 is used or the electrostatic charge on the donor roll 136 will cause the toner particles to be pulled from the transport roll 156 in a case where a donor roll 136 is used.

Figure 2:
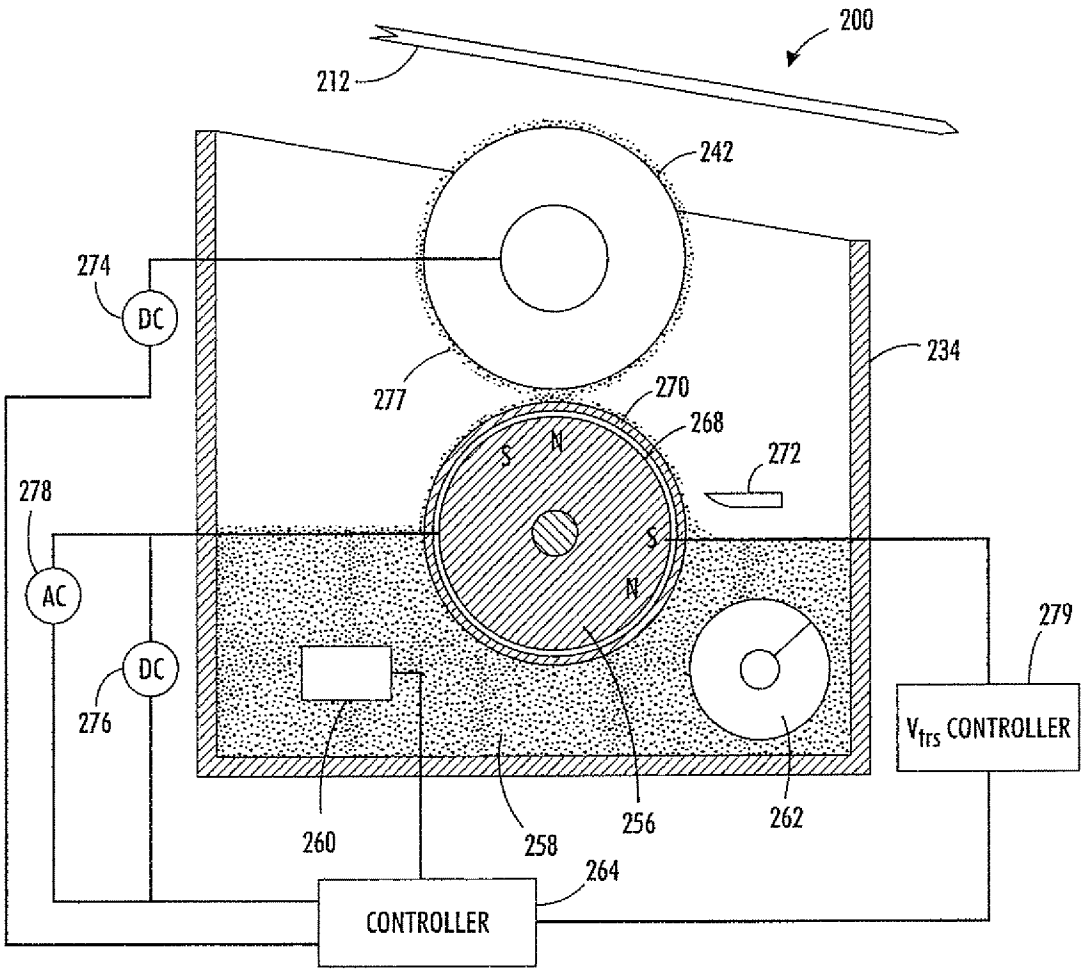
FIG. 2 illustrates a schematic view of an image processing apparatus including the systems and methods according to the disclosure.

FIG. 2 shows a developing station 200 for developing a latent image on photoconductive surface 212 with developer material 258 in greater detail. The housing 234 can define a chamber for holding a supply of developer material 258. Positioned within the housing 234 can be an auger 262. The auger 262 can distribute the developer material 258 throughout the housing 234 to facilitate uniform coverage along the length of a transport roll 256. The transport roll 256 can be positioned within the housing 234 such that a lowermost part of transport roll 256 is continuously immersed in the supply of developer material 258.

The transport roll 256 can include a multi-polar magnet 268 and a sleeve 270. The sleeve 270 can be formed of a non-magnetic material, for example, aluminum. The sleeve 270 can be designed to rotate about the multi-polar magnet 268. The transport roll 256 also can have one or more Vtrs controllers 279. The Vtrs controller 279 adjusts the rotational speed Vtrs of the transport roll. As the developer material 258 can include magnetic carrier granules in the case of a two-component developer material or electrostatically charged toner particles 277 in the case of a one-component developer material, the rotation of the sleeve 270 through the magnetic field of the transport roll 256 causes the developer material 258 to be attracted from the supply within the housing 234 to the exterior of the sleeve 270. A blade 272 can be positioned in close proximity to the transport roll 256 to limit the radial depth of the developer material 258 that adheres to the transport roll 256. The velocity of the transport roll 256 can also be adjusted to control the amount of developer material 258 that adheres to the transport roll 256.

The donor roll 242 can be positioned in close proximity to the transport roll 256 and kept at a continuous potential $Vdr_{DC}$ by a direct current power supply 274 in order to attract a thin layer of toner particles 277 from the transport roll 256. The donor roll 242 may be fabricated of a material having low conductive properties. The material should be conductive enough to reduce or prevent a build up of electrical charge over time, yet insulative enough so as to prevent shorting or arcing between the magnetic carrier granules in the case of a two-component developer material or the transport roll 256.

The transport roll 256 can be kept at a continuous potential $Vtr_{DC}$ by a direct current power supply 276. The resulting DC electrical field created can enhance the attraction of the developer material 258 to the sleeve 270. The transport roll 256 can also be kept at a variable potential $Vtr_{AC}$ by an alternating current power supply 278. The resulting AC electrical field created can loosen the toner particles 277 from the magnetic carrier granules of the developer material 258 facilitating the transfer of the toner particles 277 from the transport roll 256 to the donor roll 242. The toner particles 277 can be loosened in the case of a two-component developer material. In the case of a one-component developer material, the transport roll 256 can facilitate the transfer of the toner particles 277 from the transport roll 256 to the donor roll 242. To control the amount of developer material 258 on the sleeve 270, the Vtrs controller 279 can also control the rotational speed of the transport roll 256.

The controller 264 may manage the potentials $Vtr_{AC}$, $Vtr_{DC}$, and $Vdr_{DC}$. The controller may also manage the rotational speed Vtrs by adjusting the Vtrs controller 279. The controller 264 can manage potentials $Vtr_{DC}$, and $Vdr_{DC}$ based on predetermined values. The controller 264 can manage $Vtr_{AC}$ and Vtrs based on an at least one variable property of the developer material 258. For example, the controller 264 may receive data relating to a property of the toner within the developer material 258 from a sensor 260 that can be disposed within the housing 234 such that the sensor 260 is in contact with or in the vicinity of the developer material 258. In embodiments, the sensor 260 can detect a property that can be necessary for the calculation of the age of the toner within the developer material 258, such as characteristics of a toner environment. The sensor 260 can send the data regarding the detected property to the controller 264. In embodiments, the toner age can be determined by the controller 264 based on a time the toner material has been in the housing 234.

For example, to determine a time the toner has been housed, the sensor 260 can sense a Toner Concentration (TC) of the toner within the developer material 258 by detecting a magnetic permeability of the toner particles 277. The sensor 260 can send data regarding the detected TC to the controller 264. The controller 264 can calculate the toner age (TA) as a function of a mass of the toner (TM), an average amount of toner output (TO), the most recent value of toner age ($TA_{t-1}$) calculated by the controller 264, and a period (P). For example:

$$TA = (TM - TO) \cdot \frac{\left(TA_{t-1} + \frac{P}{60}\right)}{TM}$$

$$TM = TC \cdot C$$

-continued $$TO = S_t \cdot \frac{PC}{100} \cdot PSF \cdot P$$

In the above, C can be a predetermined constant, $S_t$ can be a predetermined Solid Area Development Developed Mass Area target value, PC can be a pixel count, and PSF can be a predetermined page size factor. $S_t$ can be predetermined based on the types of toner used, the recording medium used, and the printing apparatus used. PC can be determined by the controller 264 based on image signals representing the desired output image similar to those that can be sent to the ESS 130 (described above, see FIG. 1). C can be predetermined based on the amount of carrier material within developer material 258. For example, C can represent toner mass per percent toner concentration.

In embodiments, the controller 264 can use the Toner Concentration alone in determining the age of the toner within the developer material 258.

In embodiments, the controller 264 can use a temperature of the toner, an amount of area coverage that a printer is printing and a mottle characteristic of an image as detected data.

Figure 3:
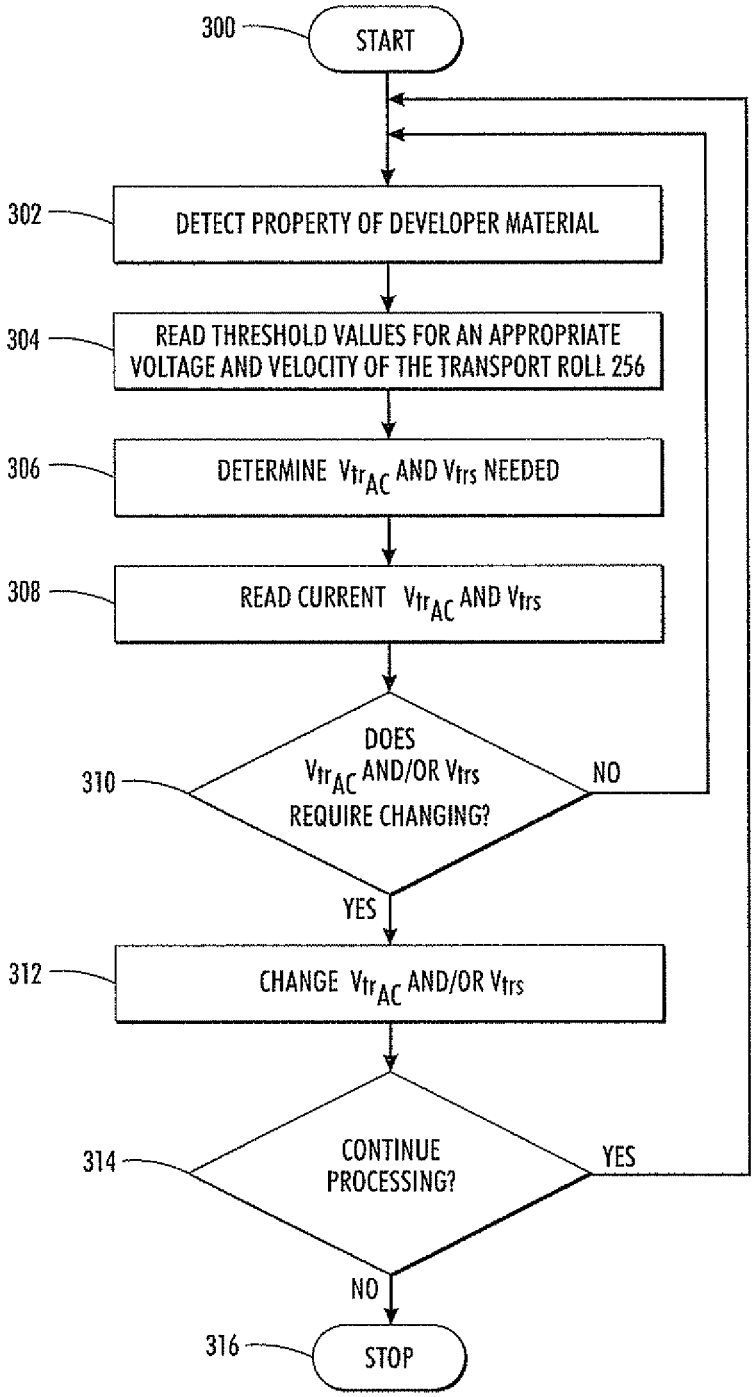
FIG. 3 illustrates a block diagram depicting processes undertaken by a controller according to this disclosure.

FIG. 3 shows the process that may be taken by the controller 264 and the sensor 260 in the determination of and the setting of the variable alternating current potential $Vtr_{AC}$ and the rotational speed Vtrs of the transport roll 256. Operation of the method begins at step 300 and proceeds to step 302.

In step 302, the controller 264 may direct the sensor 260 to detect and return data regarding a property of the developer material 258. Operation of the method proceeds to step 304.

In step 304, the controller 264 may read threshold values for an appropriate voltage and velocity of the transport roll 256. Operation of the method proceeds to step 306.

In step 306, the controller 264 can use the property of the developer material 258 and the threshold values to determine the potential $Vtr_{AC}$ and the rotational speed Vtrs required achieving the desired image quality. Operation of the method proceeds to step 308.

In step 308, the controller 264 can read the current potential $Vtr_{AC}$ and the rotational speed Vtrs of the transport roll 256. Operation of the method proceeds to step 310.

In step 310, the controller 264 may use the current potential $Vtr_{AC}$ and rotational speed Vtrs of the transport roll 256 and the potential $Vtr_{AC}$ and rotational speed Vtrs needed, to determine if at least one of the current potential $Vtr_{AC}$ and rotational speed Vtrs should be changed. For example, if the current potential $Vtr_{AC}$ and rotational speed Vtrs are equal to or within an acceptable range of the potential $Vtr_{AC}$ and rotational speed Vtrs needed, then the controller 264 may determine that the potential $Vtr_{AC}$ and rotational speed Vtrs does not need to be changed. If the controller 264 determines that the current potential $Vtr_{AC}$ and rotational speed Vtrs should be changed to the newly determined needed potential, operation of the method proceeds to step 312, otherwise operation of the method may revert to step 300, continuously or at intervals.

In step 312, the current potential $Vtr_{AC}$ and/or rotational speed Vtrs are adjusted. Operation of the method proceeds to step 314.

In step 314, the controller 264 determines whether further processing to enhance image quality must be completed. If the controller 264 determines that further adjustments to the current potential $Vtr_{AC}$ and/or rotational speed Vtrs are necessary, then operation of the method may revert to step 300. Otherwise, operation of the method proceeds to step 316 where the method ends.

Figure 4:
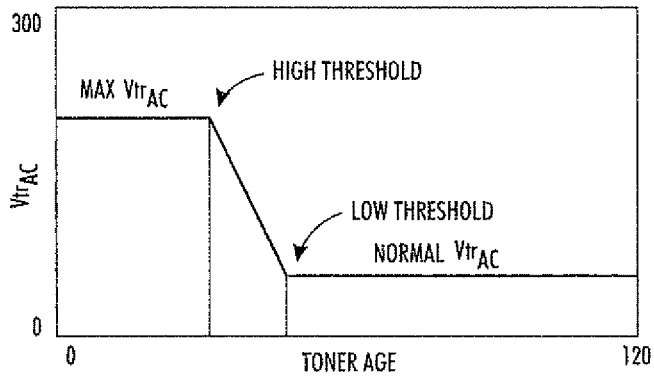
FIGS. 4-6 illustrate relationships between measured voltage and toner age.

The threshold values may be predetermined specific to the property to be used by the controller 264 for determining the needed potential $Vtr_{AC}$ and rotational speed Vtrs of the transport roll 256. In embodiments, when toner age is the property being used, the potential $Vtr_{AC}$ may be set by the controller 264 at a maximum potential when the age of the toner within the developer material 258 is less than a high threshold. The potential $Vtr_{AC}$ may be set by the controller 264 at a nominal potential when the age of the toner within the developer material 258 is greater than a low threshold. When age of the toner within the developer material 258 is between the high and the low thresholds, the controller 264 can linearly decrease the potential $Vtr_{AC}$ as the age of the toner within developer material 258 increases. This exemplary relationship between toner age and potential $Vtr_{AC}$ of the transport roll 256 is shown in FIG. 4.

Figure 5:
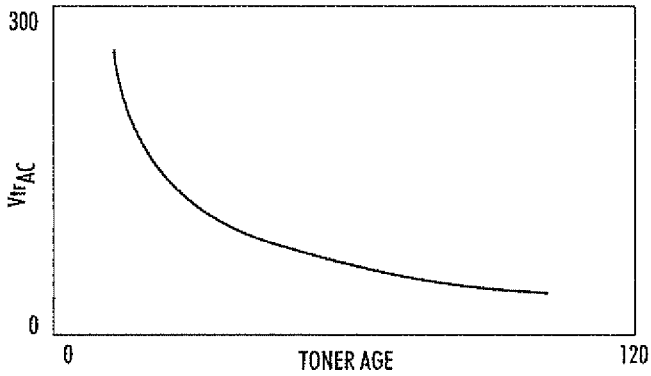
Figure 6:
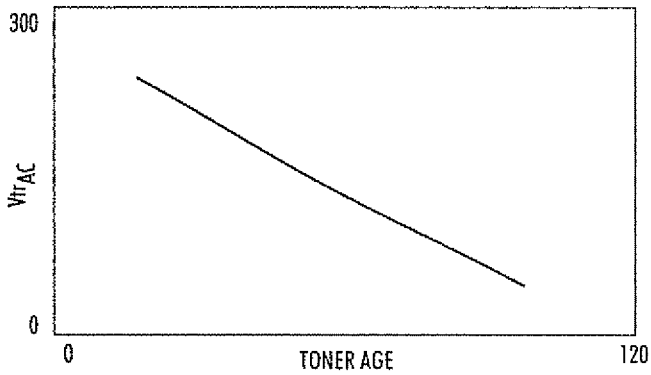
Figure 7:
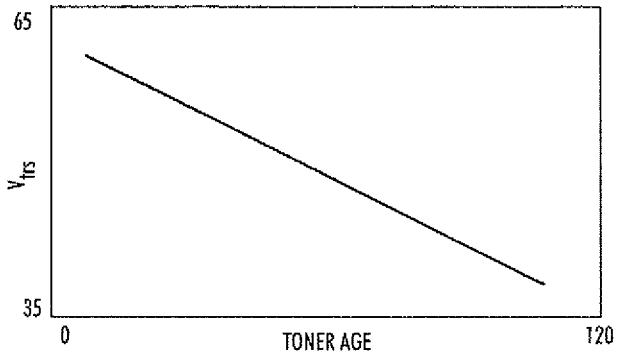
FIGS. 7-9 illustrate relationships between transport roll velocity and toner age.
Figure 8:
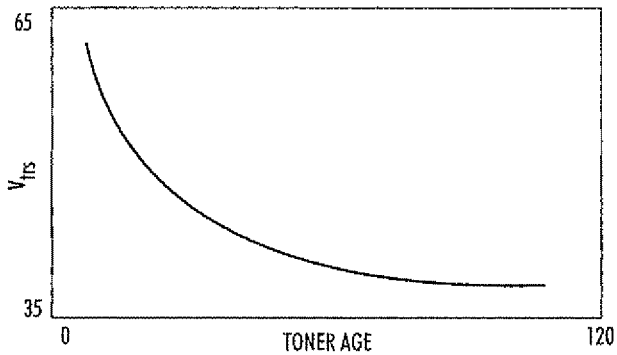

In embodiments, the controller 264 can exponentially decrease the potential $Vtr_{AC}$ as the age of the toner within the developer material 258 increases. This relationship between toner age and potential $Vtr_{AC}$ of the transport roll 256 is shown in FIG. 5. Further, in embodiments, the controller 264 can linearly decrease the potential $Vtr_{AC}$ as the age of the toner within the developer material 258 increases. This relationship between toner age and potential $Vtr_{AC}$ of the transport roll 256 is shown in FIG. 6. By adjusting the Vtrs controller 279, the controller 264 can decrease the rotational speed Vtrs linearly as the age of the toner within developer material 258 increases. This relationship between toner age and rotational speed Vtrs of the transport roll 256 is shown in FIG. 7. By adjusting the Vtrs controller 279, the controller 264 can exponentially decrease the rotational speed Vtrs as the age of the toner within the developer material 258 increases. This relationship between toner age and rotational speed Vtrs of the transport roll 256 is shown in FIG. 8.

Figure 9:
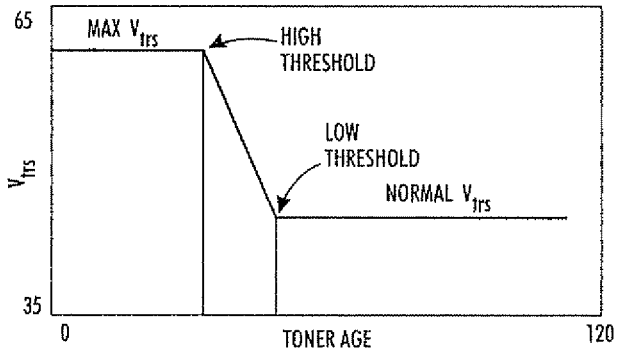
Figure 10:
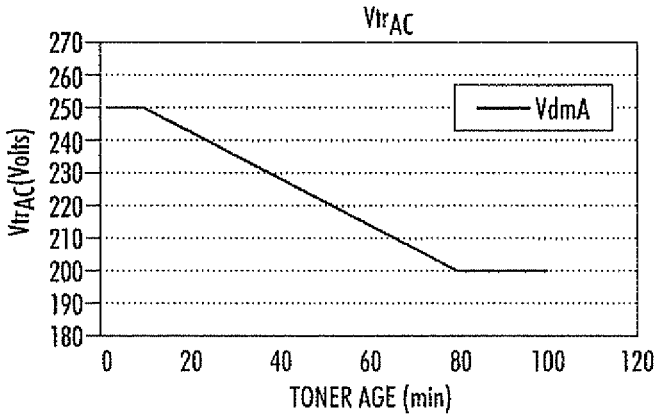
FIGS. 10-13 illustrate relationships between voltage and transport roll velocity to toner age from a software algorithm.
Figure 11:
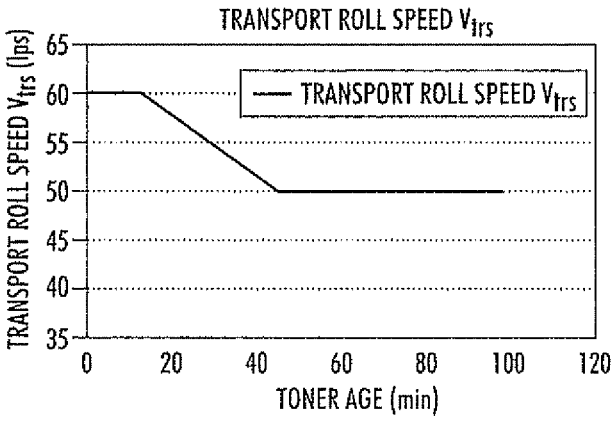

In embodiments, when toner age is the property being used, by adjusting the Vtrs controller 279, the rotational speed Vtrs may be set by the controller 264 at a maximum velocity when the age of the toner within the developer material 258 is less than a high threshold. By adjusting the Vtrs controller 279, the rotational speed Vtrs may be set by the controller 264 at a nominal speed when the age of the toner within the developer material 258 is greater than a low threshold. When age of the toner within the developer material 258 is between the high and the low thresholds, by adjusting the Vtrs controller 279, the controller 264 can linearly decrease the rotational speed Vtrs as the age of the toner within developer material 258 increases. This exemplary relationship between toner age and rotational speed Vtrs of the transport roll 256 is shown in FIG. 9.

Figures 12, 13:
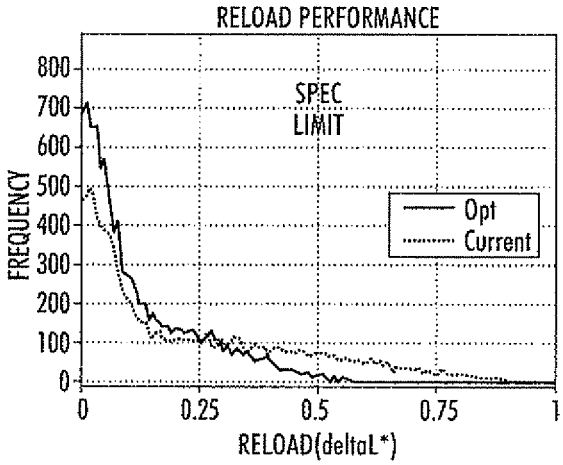

FIG. 10-13 shows the relationship between voltage and velocity of the transport roll 256 based on the toner age parameter. A software algorithm manipulates both the voltage and the velocity of the transport roll 256 based on the toner age parameter currently calculated in the machine. The Vtrs controller 279 of the transport roll 256 move in a continuous linear function between upper and lower limits, which are optimized as a function of the system operation limits. The control algorithms can be concurrently optimized using an experimentally derived transfer function, as illustrated in FIG. 12. As a result of this optimized condition, a significant reduction in the reload defect is predicted.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. An image forming apparatus comprising:

a sensor that detects at least one property of a developer material;

a transport unit that contacts the developer material during operation, and that moves the developer material toward a recording medium; and a controller that receives data regarding the at least one property of the developer material from the sensor unit and sets both an attraction voltage and a velocity of the transport unit based on the data regarding the detected at least one property of the developer material, wherein the controller sets the attraction voltage and the velocity to maximum constant values when the data regarding the at least one property is a value that is less than a first property threshold value, the controller sets the attraction voltage and the velocity to minimum constant values greater than zero when the data regarding the at least one property is a value that is greater than a second property threshold value, and the controller decreases the attraction voltage and the velocity linearly as the data regarding the at least one property increases when the data regarding the at least one property is a value between the first property threshold value and the second property threshold value.

2. The image forming apparatus of claim 1, wherein the at least one property of the developer material is toner age calculated as a time that toner resides in a housing.

3. The image forming apparatus of claim 1, wherein the transport unit further comprises at least one speed controller.

4. The image forming apparatus of claim 3, wherein the controller decreases the velocity of the at least one speed controller linearly as a value based on data of the at least one property increases.

5. The image forming apparatus of claim 1, wherein the at least one property of the developer material further comprises at least one of an amount of area coverage that a printer is printing, a temperature of the toner, a mottle characteristic of an image and a toner concentration in the housing.

6. A xerographic image forming device comprising the image forming apparatus of claim 1.

7. A system for forming an image comprising:

a means for detecting at least one property of a developer material;

a means for moving the developer material toward a recording medium, an amount of the developer material moved toward the recording medium being controlled by varying at least one of an attraction voltage of the moving means and a velocity of the moving means; and a means for setting both the attraction voltage and the velocity of the moving means based on data regarding the detected at least one property of the developer material received from the detecting means, wherein the means for setting the attraction voltage and the velocity sets the attraction voltage and the velocity to maximum constant values when the at least one property is a value that is less than a first property threshold value, sets the attraction voltage and the velocity to minimum constant values greater than zero when the at least one property is a value greater than a second property threshold value and decreases the attraction voltage and the velocity linearly as the at least one property increases when the at least one property is a value between the first property threshold value and the second property threshold value.

8. The system for forming an image according to claim 7, wherein the property of the developer material is toner age calculated as a time that toner resides in a housing.

9. The system for forming an image according to claim 7, wherein the moving means further comprises at least one speed controller, and the setting means decreases the velocity of the at least one speed controller linearly as a value based on data of the at least one property increases.

10. A xerographic image forming device comprising the image forming system according to claim 7.

11. A method for forming an image comprising:

detecting at least one property of a developer material;

moving the developer material toward a recording medium with a transport unit; and controlling an amount of developer material moved toward the recording medium by setting both an attraction voltage and a velocity of the transport unit based on data regarding the detected at least one property of the developer material, wherein setting the attraction voltage and the velocity of the transport unit includes setting the attraction voltage and the velocity to maximum constant values when the at least one property is a value that is less than a first property threshold value, sets the attraction voltage and velocity to minimum constant values greater than zero when the at least one property is a value that is greater than a second property threshold value and decreases the attraction voltage and velocity linearly as the at least one property increases when the at least one property is a value that is between the first property threshold value and the second property threshold value.

12. The method for forming an image according to claim 11, wherein the property of the developer material is toner age calculated as a time that toner resides in a housing.

13. The method for forming an image according to claim 11, wherein the transport unit further comprises at least one speed controller and the controller decreases the velocity of the at least one speed controller linearly as a value based on data of the at least one property increases.

* * * * *